United States Patent [19]

Reist

[11] Patent Number: 4,795,418

[45] Date of Patent: Jan. 3, 1989

[54] APPARATUS FOR PRESSING THE FOLDED EDGES OF FOLDED PAPER PRODUCTS WHICH ARE CONVEYED BY A CONVEYOR

[75] Inventor: Walter Reist, Hinwil, Switzerland

[73] Assignee: Ferag AG, Hinwil, Switzerland

[21] Appl. No.: 878,437

[22] Filed: Jun. 25, 1986

[30] Foreign Application Priority Data

Jun. 28, 1985 [CH] Switzerland ..... 2787/85

[51] Int. Cl.[4] ..... B31F 1/00

[52] U.S. Cl. ..... 493/422; 493/416; 493/401; 270/45; 271/204

[58] Field of Search ..... 493/401, 405, 406, 409, 493/416, 417, 422, 423, 424, 445, 448, 449, 451, 457; 270/45, 54; 198/803.9; 271/204

[56] References Cited

U.S. PATENT DOCUMENTS

| | | | |
|---|---|---|---|
| 2,659,437 | 11/1953 | Huck | 83/88 |
| 2,991,072 | 7/1961 | Dietrich | 493/432 |
| 3,572,689 | 3/1971 | Murphy | 493/422 |
| 3,580,562 | 5/1971 | Reist | 270/54 |
| 3,955,667 | 5/1976 | Müller et al. | 414/112 |
| 4,197,045 | 4/1980 | Stauber | 100/274 |

FOREIGN PATENT DOCUMENTS

| | | |
|---|---|---|
| 1761077 | 4/1971 | Fed. Rep. of Germany . |
| 644816 | 8/1984 | Switzerland . |

*Primary Examiner*—Frederick R. Schmidt
*Assistant Examiner*—Robert Showalter
*Attorney, Agent, or Firm*—Werner W. Kleeman

[57] ABSTRACT

A conveyor is provided with clamps or grippers which are spaced from each other. These clamps grasp the edge opposite to the folded edge or fold of a paper product, especially a newspaper, and transport the paper product in a suspended manner. A pair of movable press or clamp elements which can be controllably driven mutually to-and-fro is associated with each of these clamps or grippers. This pair of movable press elements is positioned underneath each of these clamps at a predetermined distance below the conveyor in the region of the path of conveyance of these suspended paper products. These pairs of movable press elements move in substantially the same direction and with substantially the same magnitude of speed as the clamps. The folded edges of the respective paper products or newspapers are clamped or pressed together between these pairs of movable press elements.

16 Claims, 4 Drawing Sheets

APPARATUS FOR PRESSING THE FOLDED EDGES OF FOLDED PAPER PRODUCTS WHICH ARE CONVEYED BY A CONVEYOR

BACKGROUND OF THE INVENTION

The present invention broadly relates to a new and improved apparatus for pressing the folded edges of folded paper products, especially printed products, which are conveyed by means of a conveyor.

Apparatuses for pressing the folded edges of folded printed products, especially of newspapers, have long been utilized in practice in the prior art. These apparatuses are designed such that the imbricated formation or flow of the printed products from the printing press arrive onto a belt or band conveyor. The folded edge of each newspaper or paper product forms the leading edge of each newspaper in the imbricated formation or product flow and overlaps a portion of the preceding newspaper or paper product. This imbricated product formation or flow is fed between one or more consecutive pairs of pressing cylinders or rollers. The folded edge of each product or newspaper thus is compressed or squeezed at the moment it passes through the gap of the individual pair of pressing cylinders or through the gaps of the plurality of pressing cylinders. The time duration elapsing during compression or squeezing of this folded edge is very short and the time duration decreases with increasing speed of conveyance of the imbricated product flow.

Paper, however, is a material which exhibits a certain resiliency or capability of recovering its shape. The very short time duration of the product compression or squeezing action of the known apparatuses is therefore not sufficient to compress the folded edges of the products in a permanent manner such that each product displays a minimum possible radius of curvature and especially can retain this minimum possible radius of curvature.

It will be understood that other apparatuses which are foreign to this type of equipment discussed previously are known for compressing the folded edges of newspapers. These known apparatuses neither compress the folded edge individually nor during conveyance of the paper products but instead press the folded edges while they are in a stack of folded paper products and especially during the formation of such a product stack. An example of such an apparatus is described in the German Patent Publication No. 2,822,029, which is substantially cognate to the Swiss Patent No. 618,399, and the U.S. Pat. No. 4,197,045, granted Apr. 8, 1980. The pressing or compression of the folded edges does not occur, as mentioned, during the passage or conveyance through the apparatus, i.e. during transportation of the paper products with these known apparatuses. The folded edges are not individually pressed, but to a certain degree are pressed collectively for all paper products already located in the product stack. Consequently, the folded edges of the paper products which are situated in the bottom or lower region of the product stack are possibly sufficiently pressed simply due to the inherent or dead weight of the paper products lying thereabove. In contrast, however, the folded edges of the paper products situated in the top or upper region of the product stack are usually not adequately pressed or compressed.

SUMMARY OF THE INVENTION

Therefore, with the foregoing in mind, it is a primary object of the present invention to provide a new and improved apparatus for pressing or compressing the folded edges of folded paper products, especially printed products such as newspapers, which are conveyed by means of a conveyor and which pressing apparatus does not exhibit the aforementioned drawbacks and shortcomings of the prior art constructions.

Another and more specific object of the present invention aims at providing a new and improved construction of an apparatus of the previously mentioned type which renders possible a compression or squeezing or pressing of sufficient time duration of the folded edge of each individual paper product during its conveyance.

Yet a further significant object of the present invention aims at providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that the conveyor is provided with clamps or grippers which are mutually spaced from each other. These clamps or grippers serve to grip the product edge located opposite to the folded edge of each paper product in order to transport this paper product in a suspended manner over a partial product conveyance path. A pair of press or clamp elements which can be controllably driven mutually to-and-fro i.e., towards and away from each other, is associated with each of these clamps or grippers and is positioned in the region of the partial product conveyance path or section at a predetermined distance below the conveyor. These pairs of press elements are controllably driven mutually to-and-fro with substantially the same magnitude of speed and in substantially the same direction as the clamps or grippers.

In this manner, the folded edge of each individual paper product is individually pressed or compressed during its time of passage through this partial product conveyance path or section.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
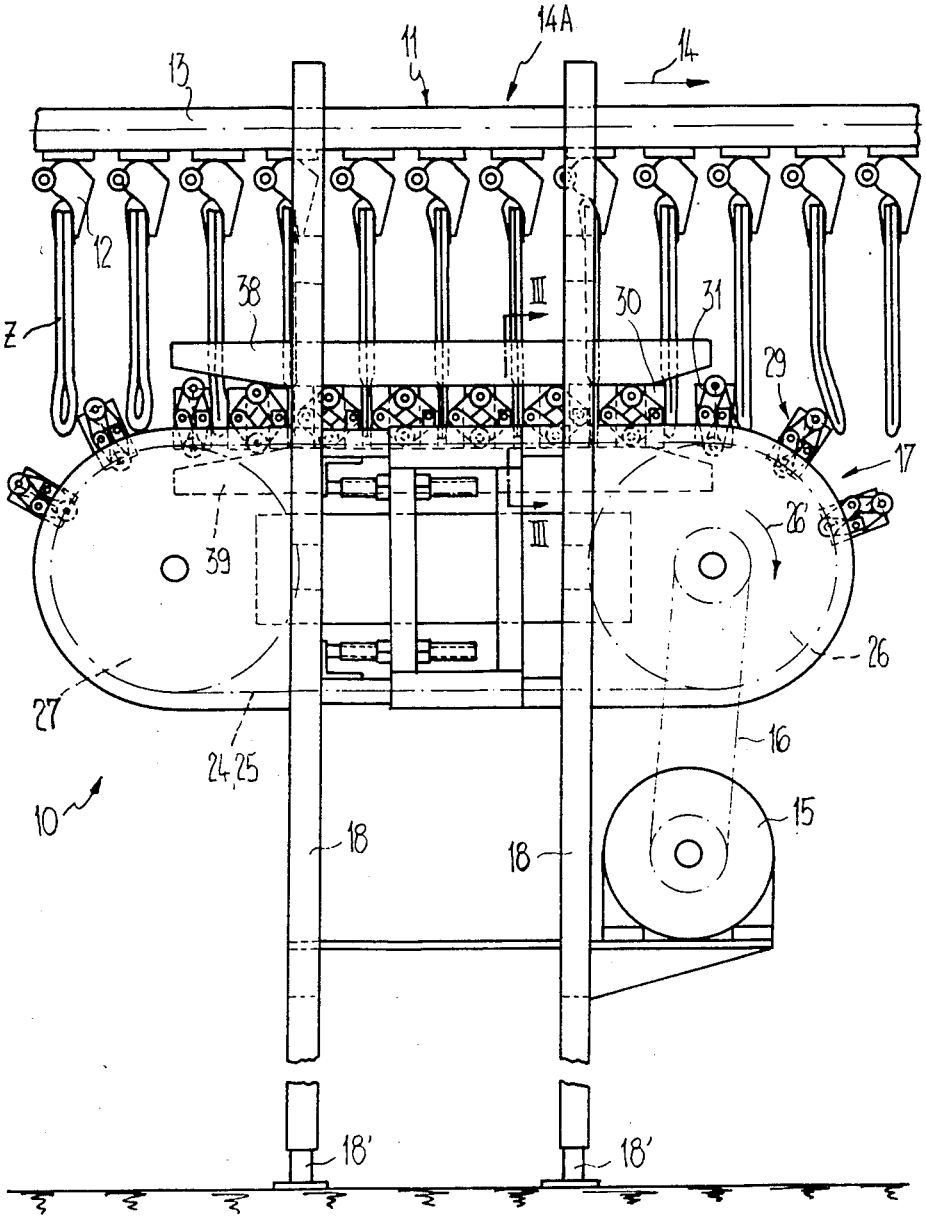
FIG. 1 is a schematic side view of an exemplary embodiment of product pressing or compressing apparatus according to the invention.

Describing now the drawings, it is to be understood that to simplify the showing thereof only enough of the structure of the apparatus for pressing the folded edges of folded paper products which are conveyed by means of a conveyor has been illustrated therein as is needed to enable one skilled in the art to readily understand the underlying principles and concepts of this invention. Turning now specifically to FIG. 1 of the drawings, the apparatus 10 illustrated therein by way of example and not limitation, will be seen to comprise a product conveyor or conveyor-like element 11. This conveyor 11 is provided with clamping means or clamps or grippers 12 which are spaced at regular or uniform distances from each other. The clamps or grippers 12 are, in turn, fastened to a not particularly illustrated conveyor chain which is guided in a hollow track or substantially U-shaped rail 13. The design of the conveyor 11 preferably corresponds substantially to that type of conveyor which is described in the U.S. Pat. No. 3,955,667, granted May 11, 1976, which is substantially cognate with the German Patent Publication No. 2,519,561.3, with the difference, however, that in the present invention, the jaw elements of the clamps or grippers 12 are positioned approximately at right angles to the direction of the substantially U-shaped rail 13. As is clearly visible in FIG. 1, each clamp or gripper 12 serves to grip a paper product or newspaper Z at its open side or fan edge which is located opposite to the folded or spine edge. The paper products or newspapers Z are thus suspended with their folded edges pointing downwards and are transported in the direction of the arrow 14 along a predetermined section 14A of their conveying path as defined by the conveyor 11.

Below the conveyor 11 there is located in the predetermined section 14A of the conveying path an endless driven arrangement 17 of pairs of press or clamp elements or jaws 30 and 31 which is driven by drive means 15 by means of a chain 16 in a manner which is yet to be described. This driven arrangement 17 and the associated drive means or unit 15 are mounted on a frame having four struts or upright support members 18 which are adjustable in height, two of which are located on each side of the conveyor 11. These upright support members 18 are supported on the floor by threaded adjustment means or feet 18'. The drive means 15 preferably is infinitely or continuously regulatable or adjustable in speed in order to adjust or match the speed of rotation of the driven arrangement 17 to the speed of conveyance of the product conveyor 11. The pairs of press elements or clamps or jaws 30 and 31 are mutually separated from one another by uniform spacings. These spacings substantially correspond to the spacing between each of the clamps or grippers 12.

The driven arrangement 17 will be described hereinbelow primarily in reference to FIGS. 2 and 3. This driven arrangement 17 comprises two substantially U-shaped rails or guide means 19 and 20 (cf. FIG. 2) which lie in planes which are substantially parallel to one another and which rails or guide means 19 and 20 are closed upon themselves i.e. endless. This driven arrangement 17 thus possesses a substantially elliptical or oval path of conveyance (cf. FIG. 1). In each of the U-shaped rails 19 and 20 there travels a respective link-chain 24 and 25 (indicated in FIG. 2 with a dotted and dashed line) via roll members or rollers 21, 22 and 23 (cf. FIG. 3). Each of these link-chains 24 and 25 is guided over a related driving sprocket or sprocket wheel 26 and a guide wheel 27 (cf. FIG. 1). The driving sprocket wheels 26 are commonly driven by means of the drive means or unit 15 in the direction of the arrow 26' i.e., in a clockwise sense as seen in FIG. 1.

Figure 2:
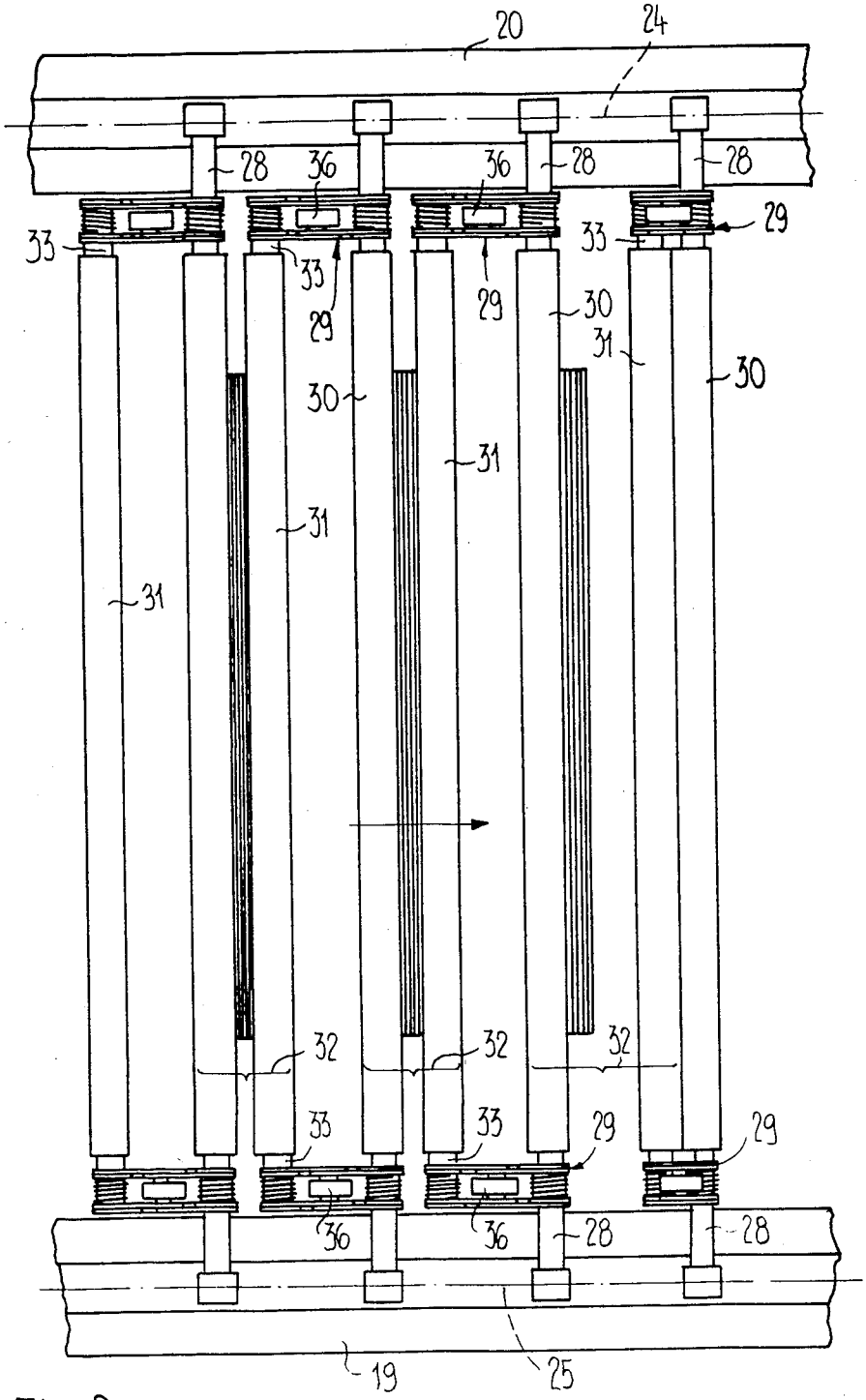
FIG. 2 is a top plan view of a portion of the apparatus shown in FIG. 1 in which three pairs of press or clamp elements are illustrated, two of which are shown in their product pressing or clamping position.
Figure 3:
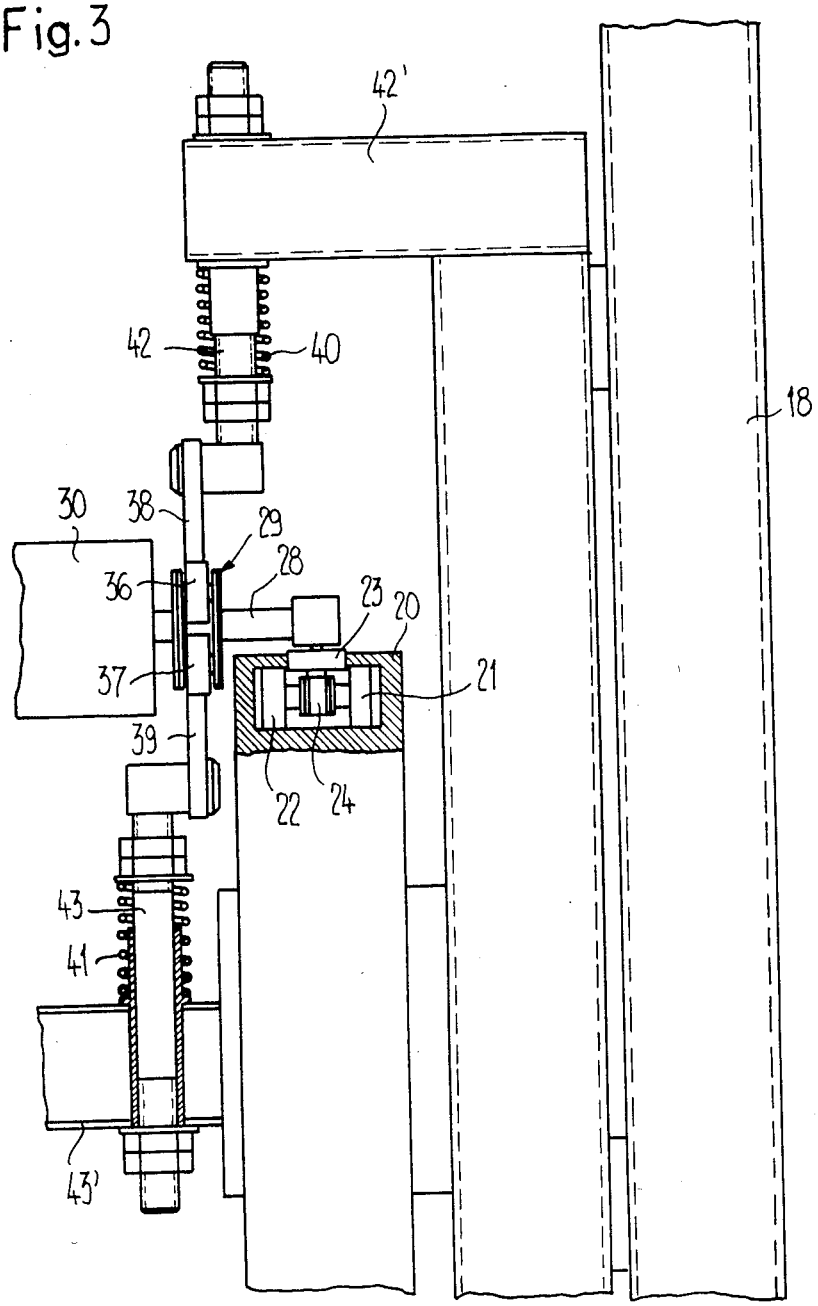
FIG. 3 is a partial section taken along the line III—III through a portion of the apparatus shown in FIG. 1.
Figures 4, 5, 6:
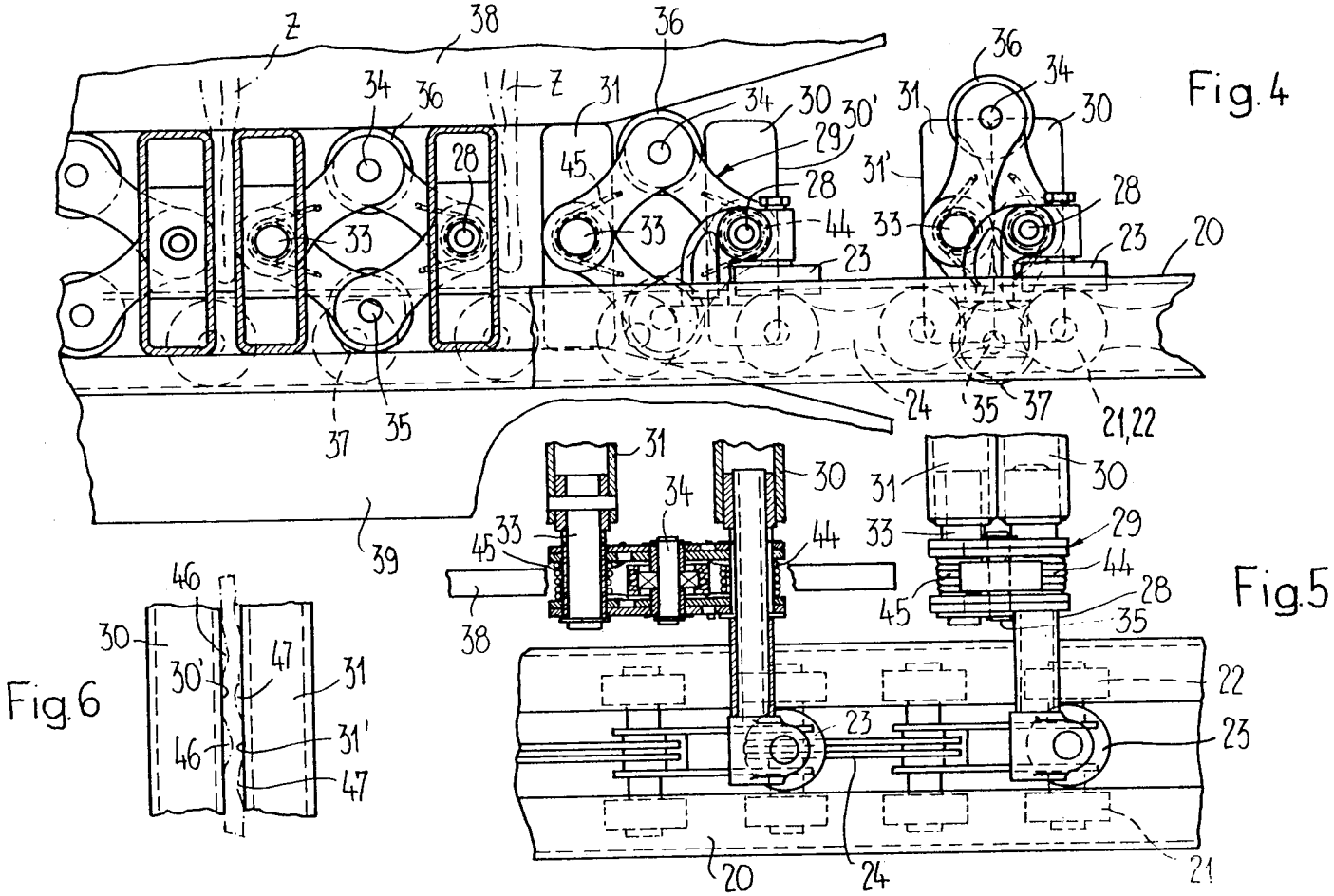
FIG. 4 is a side view of the hinged or articulated transmission mechanism associated with the pairs of press or clamp elements and their co-operation with associated connecting links or members.
FIG. 5 is a top plan view of the right-hand portion of FIG. 4 shown in partial section.
FIG. 6 is a top plan view of a modified embodiment of the press elements.

As can be seen in reference to FIGS. 2, 3 and 5, each of the journals or stub shafts of the rollers 23 possess a laterally projecting arm or cantilever 28. Each of these cantilever arms 28 also form a link or hinge pin of a four-membered hinged or articulated transmission mechanism 29 having four equally long members. These cantilever arms 28 are not movable with respect to the link chains 24 and 25. Each of these cantilever arms 28 additionally supports an end of the press element or jaw 30 which is non-movable in relation to the link-chains 24 and 25. Each of these relatively non-movable press elements or jaws 30 is associated with a related press element 31. Each press element 31 is movable in relation to the link-chains 24 and 25. Each pairing of these press elements 30 and 31 is indicated in FIG. 2 with curved brackets 32. Each relatively non-movable press element or jaw 30 is supported by the related cantilever arm 28 of two oppositely situated articulated transmission mechanisms 29, i.e. from the link or hinge pin formed by the corresponding cantilever arm 28 which is non-movable with respect to the link-chains 24 and 25. The associated movable press element or jaw 31 is supported by the movable link or hinge pin 33. This movable hinge pin or link 33 is located opposite to the non-movable hinge or link pin (defined by the related cantilever arm 28) of two adjacent, articulated transmission mechanisms 29. Especially the movable press element or jaw 31 of a pair of such press elements or jaws 30 and 31 is coupled to the associated articulated transmission mechanism 29 which proceeds or leads each articulated transmission mechanism 29 which supports the associated relatively non-movable press element 30 of the pair 30, 31.

It can be seen in reference to FIGS. 4 and 5 that both remaining hinge pins 34 and 35 which are movable or displaceable with respect to the link-chains 24 and 25 each support an associated follower member in the form of a freely rotating follower roll or roller 36 and 37, respectively. These follower rollers 36 and 37 are preferably made from a synthetic material or plastic. The follower rollers 36 co-operate with a cam plate or ramp 38 and the follower rollers 37 co-operate with a cam plate or ramp 39. It can be seen with reference to FIG. 3 that the cam plates or ramps 38 and 39 are positioned with their contact surfaces facing or confronting one another and extend substantially parallel to the link-chains 24 and 25. Each of the cam plates or ramps 38 and 39 is supported on a respective adjustable thrust or support rod 42 and 43. Each of these adjustable thrust or support rods 42 and 43 is resiliently biased by a respective compression spring 40 and 41. These adjustable thrust or support rods 42 and 43, in turn, are longitudinally displaceable and mounted or positioned in extension arms or cantilevers 42' and 43' which are firmly connected with the upright support members 18.

As can be seen with reference to FIGS. 4 and 5, a respective helical or hairpin spring 44 and 45 is wound about the respective cantilever arm 28 and hinge pin 33 of each of the four-membered articulated transmission mechanisms 29. These helical or hairpin springs 44 and 45 urge the corresponding articulated transmission mechanism 29 into the shape of a substantially upright, elongated rhombus or rhombic shape (cf. the right side of FIG. 4). That is to say, these helical or coil springs 44 and 45 urge the press element 31 which is co-displaceable with the hinge pin 33 away from the associated subsequent press element 30 which is stationary relative to the link-chains 24 and 25. If, on the other hand, the follower rollers 36 and 37 run onto or come into contact with the contact tracks or surfaces of the associated cam plates or ramps 38 and 39, respectively, then the respective articulated transmission mechanism 29 is compressed or deformed so that it tends to assume the shape of a substantially horizontal rhombus as is shown in the left-hand portion of FIG. 4. In this manner, however, the hinge pins 33, which are movable or displaceable with respect to the link-chains 24 and 25 and thus the displaceable or movable press elements 31 which are supported by these hinge pins 33, are closed or advanced toward the associated relatively non-movable press element 30. These press elements or clamps 30 and 31 thus clamp the folded edge of an associated newspaper Z or printed product or the like therebetween and therefore press or compress such clamped newspaper Z.

The strength or compressive force of the compression springs 40 and 41 is designed such that they overcome the counter-acting force of the helical or coil springs 44 and 45 of all of the articulated transmission mechanisms 29 which are located in the region of the cam plates or ramps 38 and 39. Due to the displaceability of the cam plates or ramps 38 and 39 in relation to each other against the effect of the compression springs 40 and 41, there is also produced an automatic adjustment of the extent of the feed or advance motion of the movable or displaceable press elements 31 toward the associated relatively non-movable press elements 30. Thus, an adjustment to the thickness of the paper products (or newspapers Z) occurs simultaneously with an increase in the pressing force or strength.

The previously described press elements or clamps 30 and 31 extend in the form of ladder rungs between both link-chains 24 and 25. These press elements 30 and 31 have circumferences or peripheries whose cross-sections are substantially rectangular. In FIGS. 1 to 4 these press elements 30 and 31 are shown as rectangular tubes or pipes. One of the longer sides of these cross-sections form the clamping or pressing surfaces 30′ and 31′ (cf. FIG. 4) of the respective press elements 30 and 31. In order to produce an even more lasting or durable folded edge of the newspapers Z or the like, especially when processing very thick newspapers or products and/or when processing products with very tough or stiff paper qualities, it can be advantageous to press the folded edge not in a substantially straight line but to "break" this substantially straight line into a wavy or undulated line. As can be seen with reference to FIG. 6, projections 46 and 47 can be provided on the clamping or pressing surfaces 30′ and 31′ of the press elements 30 and 31, respectively. These projections 46 and 47 extend substantially transverse to the pressing surfaces 30′ and 31′, respectively. The projections 46 on the pressing surface 30′ are positioned such that their apex or crown lies between two projections 47 on the oppositely situating or confronting pressing surface 31′.

The previously described installation for pressing the folded edge of fold of folded paper products is especially advantageous because the frame supporting the driven arrangement 17 of the press elements or clamps 30 and 31 together with its drive means 15 can be installed or erected at different locations along the length of the conveyor 11 physically independent therefrom. The inventive pressing apparatus can even be utilized with an existing conveyor, if this conveyor, as previously mentioned, is provided with controllable clamps or grippers for gripping each copy of the paper products or newspapers Z at their edge which is located opposite to the folded edge or fold. The duration or length of time during which the folded edge is pressed or compressed depends upon the feed of conveyance of the conveyor 11 and upon the length of the upper run of the link-chains 24 and 25, as well as upon the length of the cam plates or ramps 38 and 39. By suitably designing the size or dimensions of these elements, it is possible to change, in a simple manner, the time duration of the compression or pressing action exerted upon the paper products or newspaper Z or the like.

While there are shown and described present preferred embodiments of the invention, it is to be distinctly understood that the invention is not limited thereto, but may be otherwise variously embodied and practiced within the scope of the follower claims.

Accordingly, what I claim is:

1. An apparatus for pressing a folded edge of folded paper products, especially of printed products, comprising:

a conveyor for conveying the folded paper products having a folded edge of a predeterminate length;

a plurality of mutually spaced clamping means provided for the conveyor;

the conveyor having a predeterminate conveying path and a conveying speed and conveying said folded paper products along a conveying path extending in a predetermined conveying direction and defining a predetermined section of said conveying path;

said plurality of mutually spaced clamping means serving for gripping an edge of each folded paper product opposite to the folded edge in order to transport each folded paper product in a suspended fashion substantially transversely to the predeterminate length of its folded edge through said predetermined section of said conveying path;

a plurality of pairs of press elements operatively associated with said predetermined section of said conveying path;

each pair of said press elements extending substantially transversely to said predetermined conveying direction and over a length at least equal to said predeterminate length of said folded edge of said suspended folded paper products and being operable to press said folded edge of one of said suspended folded paper products along substantially the entire predeterminate length of said folded edge;

drive means for circulatingly driving said plurality of pairs of press elements at a predeterminate driving speed in a predetermined driving direction;

each pair of said plurality of pairs of press elements being located in the region of said predetermined section of said conveying path at a predetermined distance below the conveyor;

said predeterminate driving speed of said drive means being substantially equal to said predeterminate conveying speed of said conveyor;

said drive means driving each one of said plurality of pairs of press elements through said predetermined section of said conveying path substantially parallel to the predeterminate conveying path of said conveyor whereby each of said plurality of pairs of press elements remain at said predetermined distance below the conveyor throughout the region of said predetermined section of said conveying path; and said folded edge of said suspended folded paper product is pressed by an associated one of said pairs of press elements and said opposite edge of said suspended folded paper product is gripped by an associated one of said clamping means, substantially throughout passage of said pair of press elements and said associated clamping means conjointly with said suspended folded paper product through said predetermined section of said conveying path.

2. The apparatus as defined in claim 1, wherein:

said drive means comprises at least one circulatingly driven, continuous traction member having a run extending substantially parallel to said predetermined section of said conveying path; and said plurality of pairs of press elements being coupled to said at least one circulatingly driven, continuous traction member.

3. The apparatus as defined in claim 2, wherein:

said plurality of pairs of press elements extend substantially transverse to said at least one circulatingly driven, continuous traction member in the form of rungs of a ladder.

4. The apparatus as defined in claim 2, wherein:

each pair of said plurality of pairs of press elements comprises a first press element which is substantially non-movable in relation to said circulatingly driven, continuous traction member and a second press element which is substantially displaceable towards and away from said substantially non-movable first press element.

5. An apparatus for pressing a folded edge of folded paper products, especially of printed products, comprising:

a conveyor for conveying the folded paper products;

a plurality of mutually spaced clamping means provided for the conveyor;

the conveyor having a predeterminate conveying speed and a conveying path extending in a predetermined conveying direction and defining a predetermined section of said conveying path;

said plurality of mutually spaced clamping means serving for gripping an edge of each folded paper product opposite to the folded edge in order to transport each folded paper product in a suspended fashion over said predetermined section of said conveying path;

a plurality of pairs of press elements cooperating with said conveyor;

drive means for circulatingly driving said plurality of pairs of press elements at a predeterminate driving speed in a predetermined driving direction;

each pair of said plurality of pairs of press elements being located in the region of said predetermined section of said conveying path at a predetermined distance below the conveyor;

said predeterminate conveying speed of said conveyor being substantially equal to said predeterminate driving speed of said drive means;

said predetermined conveying direction extending substantially parallel to said predetermined driving direction;

said drive means comprising at least one circulating driven, continuous traction member having a run extending substantially parallel to said predetermined section of said conveying path;

said plurality of pairs of press elements being coupled to said at least one circulatingly driven, continuous traction member;

each pair of said plurality of pairs of press elements comprising a first press element which is substantially non-movable in relative to said circulatingly driven, continuous traction member and a second press element which is substantially displaceable towards and away from said substantially non-movable first press element;

a plurality of articulated transmission mechanisms;

at lest one stationary cam plate;

at least one follower member supported on each articulated transmission mechanism of said plurality of articulated transmission mechanisms for co-acting with said at least one cam plate;

at least one spring provided for each articulated transmission mechanism for urging said at least one follower member of the associated articulated transmission member into contact with said at least one cam plate;

each said second press element being displaceable against the action of said at least one spring of its associated articulated transmission mechanism toward an associated relatively non-movable first press element by means of said at least one follower member of said associated one of said plurality of transmission mechanisms and which said at least one follower member co-acts with said at least one cam plate;

each said transmission mechanism comprising four link members and four hinge pins;

each link member of said hour link members having two ends and being linked at each end of said two ends to an associated end of an associated link member of said four link members by a respective hinge pin of said four hinge pins;

a predetermined one of said four hinge pins supporting said first press element of one of said plurality of pairs of press elements;

a further predetermined hinge pin of said four hinge pins which is oppositely located relative to said predetermined one of said four hinge pins supporting said first press element of an adjacent pair of said plurality of pairs of press elements;

said at least one follower member being supported by an intermediate hinge pin of said four hinge pins disposed intermediate said predetermined one and said further predetermined hinge pin;

said at least one cam plate comprises at least two mutually confronting cam plates; and said at least two mutually confronting cam plates being positioned in said predetermined section of said conveying path for co-acting with said at least one follower member.

6. The apparatus as defined in claim 5, further including:

means for resiliently pre-biasing at least one cam plate of said at least two mutually confronting cam plates toward the other cam plate of said at least two mutually confronting cam plates.

7. The apparatus as defined in claim 5, wherein:

each said articulated transmission mechanism having substantially the shape of a rhombus; and said at least one spring provided for each of said plurality of articulated transmission mechanisms being arranged to elongate each said rhombus of its associated articulated transmission mechanism.

8. The apparatus as defined in claim 1, wherein:

each said pair of press elements comprises a first press element and a second press element;

each said first and second press elements possessing a substantially flat pressing face; and each said substantially flat pressing face confronting an associated pressing face of an adjacent pair of press elements.

9. The apparatus as defined in claim 8, wherein:

each said pressing face is provided with a plurality of projections; and each said plurality of projections being laterally displaced relative to said plurality of projections of an adjacently confronting pressing face.

10. The apparatus as defined in claim 1, further including:

fixable adjustment means for adjusting said plurality of pairs of press elements in relation to a desired vertical distance from the conveyor.

11. The apparatus as defined in claim 10, wherein:

said fixable adjustment means fixedly locating the pressing apparatus at said desired vertical distance from the conveyor.

12. The apparatus as defined in claim 4, wherein:

said at least one circulatingly driven continuous traction member having a predetermined direction of motion; and said first press element of each pair of said plurality of pairs of press elements is positioned ahead of the associated second press element of such pair as seen in said direction of motion of said at least one circulatingly driven, continuous traction member.

13. The apparatus as defined in claim 4, further including:

a plurality of articulated transmission mechanisms associated with said predetermined section of said conveying path;

each one of said plurality of clamping means which grip the folded paper product at the edge opposite said folded edge, being operatively associated, in said predetermined section of said conveying path, with a predetermined first press element and a predetermined second press element of mutually adjacent articulated transmission mechanisms;

at least one stationary cam plate;

at least one follower member supported on each articulated transmission mechanism of said plurality of articulated transmission mechanism for co-acting with said at least one cam plate;

at least one spring provided for each articulated transmission mechanism for urging said at least one follower member of the associated articulated transmission member into contact with said at least one cam plate; and each said second press element being displaceable against the action of said at least one spring of its associated articulated transmission mechanism toward an associated relatively non-movable first press element by means of said at least one follower member of said associated one of said plurality of transmission mechanism and which said at least one follower member co-acts with said at least one cam plate.

14. An apparatus for pressing folded paper products at a folded edge having a predeterminate length, especially of printed products, which are conveyed by means of a conveyor having a plurality of mutually spaced clamping means, the conveyor having a predetermined conveying speed and conveying said folded paper products along a conveying path extending in a predetermined conveying direction and defining a predetermined section of said conveying path, said plurality of mutually spaced clamping means serving for gripping an edge of each folded paper product opposite to the folded edge in order to transport each folded paper product in a suspended fashion substantially transversely to the predeterminate length of its folded edge through said predetermined section of said conveying path, said pressing apparatus comprising:

a plurality of pairs of press elements operatively associated with said predetermined section of said conveying path;

each pair of said press elements extending substantially transversely to said predetermined conveying direction and over a length at least equal to said predeterminate length of said folded edge of the suspended folded paper products and being operable to press said folded edge of one of said suspended folded paper products along substantially the entire predeterminate length of said folded edge;

drive means for circulatingly driving said plurality of pairs of press elements at a predetermined driving speed in a predetermined driving direction;

each pair of said plurality of pairs of press elements being located in the region of said predetermined section of said conveying path at a predetermined distance below the conveyor;

said predeterminate driving speed being substantially equal to said predeterminate conveying speed;

said drive means driving each one of said plurality of pairs of press elements through said predetermined section of said conveying path substantially parallel to the predeterminate conveying path of said conveyor whereby each of said plurality of pairs of press elements remain at said predetermined distance below the conveyor throughout the region of said predetermined section of said conveying path; and said folded edge of said suspended folded paper product is pressed by an associated one of said pairs of press elements and said opposite edge of said suspended folded paper product is gripped by an associated one of said clamping means, substantially throughout passage of said pair of press elements and said associated clamping means conjointly with said suspended folded paper product through said predetermined section of said conveying path.

15. An apparatus for pressing a folded edge of folded paper products, especially of printed products, comprising:

a conveyor for conveying the folded paper products;

a plurality of mutually spaced clamping means provided for the conveyor;

the conveyor having a predeterminate conveying path and a conveying speed and conveying said folded paper products along a conveying path extending in a predetermined conveying direction and defining a predetermined section of said conveying path;

said plurality of mutually spaced clamping means serving for gripping an edge of each folded paper product opposite to the folded edge in order to transport each folded paper product in a suspended fashion through said predetermined section of said conveying path;

a plurality of pairs of press elements operatively associated with said predetermined section of said conveying path;

actuating means operatively associated with said plurality of pairs of press elements and said predetermined section of said conveying path;

said actuating means acting upon each one of said plurality of pairs of press elements for pressing said folded edge of an associated suspended folded paper product;

drive means for circulatingly driving said plurality of pairs of press elements at a predeterminate driving speed in a predetermined driving direction;

each pair of said plurality of pairs of press elements being circulatingly driven by said drive means so as to be passed by said predetermined section of said conveying path at a predetermined distance below the conveyor;

said predeterminate driving speed of said drive means being substantially equal to said predeterminate conveying speed of said conveyor;

said drive means driving each one of said plurality of pairs of press elements through said predetermined section of said conveying path substantially parallel to the predeterminate conveying path of said conveyor whereby each of said plurality of pairs of press elements remain at said predetermined distance below the conveyor throughout the region of said predetermined section of said conveying path; and said folded edge of said associated suspended folded paper product is pressed by said pair of press elements and said opposite edge of said associated suspended folded paper product is gripped by said associated clamping means, substantially throughout passage of said pair of press elements and said associated clamping means conjointly with said associated suspended folded paper product through said predetermined section of said conveying path.

16. An apparatus for pressing a folded edge of folded paper products, especially of printed products, which are conveyed by means of a conveyor having a plurality of mutually spaced clamping means, the conveyor having a predetermined conveying speed and conveying said folded paper products along a conveying path extending in a predetermined conveying direction and defining a predetermined section of said conveying path, said plurality of mutually spaced clamping means serving for gripping an edge of each folded paper product opposite to the folded edge in order to transport each folded paper product in a suspended fashion through said predetermined section of said conveying path, said pressing apparatus comprising:

a plurality of pairs of press elements operatively associated with said predetermined section of said conveying path;

actuating means operatively associated with said plurality of pairs of press elements and said predetermined section of said conveying path;

said actuating means acting upon each one of said plurality of pairs of press elements for pressing said folded edge of an associated suspended folded paper product;

drive means for circulatingly driving said plurality of pairs of press elements at a predetermined driving speed in a predetermined driving direction;

each pair of said plurality of pairs of press elements being circulatingly driven by said drive means so as to be passed through said predetermined section of said conveying path at a predetermined distance below the conveyor;

said predeterminate driving speed being substantially equal to said predeterminate conveying speed;

said drive means driving each one of said plurality of pairs of press elements through said predetermined section of said conveying path substantially parallel to a predeterminate conveying path of said conveyor whereby each of said plurality of pairs of press elements remain at said predetermined distance below the conveyor throughout the region of said predetermined section of said conveying path; and said folded edge of said associated suspended folded paper product is pressed by said pair of press elements and said opposite edge of said associated suspended folded paper product is gripped by said associated clamping means, substantially throughout passage of said pair of press elements and said associated clamping means conjointly with said associated suspended folded paper product through said predetermined section of said conveying path.

* * * * *